United States Patent [19]

Aretz et al.

[11] Patent Number: 4,558,829

[45] Date of Patent: Dec. 17, 1985

[54] AUTOMATIC COIL WINDING MACHINE

[75] Inventors: Ulrich Aretz, Korschenbroich; Herbert Knors; Wilhelm Maassen, both of Monchen-Gladbach; Franz-Josef Reiners, Ratheim; Leo Tholen, Heinsberg, all of Fed. Rep. of Germany

[73] Assignee: W. Schlafhorst & Co., Monchen-Gladbach, Fed. Rep. of Germany

[21] Appl. No.: 559,866

[22] Filed: Dec. 8, 1983

[30] Foreign Application Priority Data

Dec. 8, 1982 [DE] Fed. Rep. of Germany ..... 3245325

[51] Int. Cl.[4] ..... B65H 54/20; B65H 67/06

[52] U.S. Cl. ..... 242/35.5 A; 221/10; 414/270

[58] Field of Search ..... 242/35.5 A, 35.5 R, 242/35.6 R, 18 R; 414/269, 270; 221/10, 11, 14

[56] References Cited

U.S. PATENT DOCUMENTS

| | | | |
|---|---|---|---|
| 2,350,927 | 6/1944 | Reiners et al. | 242/35.5 A |
| 3,538,990 | 11/1970 | Brouwer et al. | 242/35.5 A X |
| 3,933,320 | 1/1976 | Tsurumi et al. | 242/35.5 R |
| 3,951,350 | 4/1976 | Uchida | 242/35.5 A |
| 3,966,141 | 6/1976 | Nishiyama et al. | 242/35.5 A |
| 3,998,397 | 12/1976 | Haberkorn et al. | 242/35.5 A |
| 4,339,090 | 7/1982 | Matsui et al. | 242/35.5 A |

*Primary Examiner*—Stanley N. Gilreath

*Attorney, Agent, or Firm*—Herbert L. Lerner; Laurence A. Greenberg; Adam A. Jorgensen

[57] ABSTRACT

An automatic coil winding machine with a multiplicity of winding stations at which supply coil magazines with respective rotary feeders are provided, and with a loading device for loading the magazines with supply coils which are moved by transporting means to the magazines, each of the supply coil magazines having a filling location for automatic feeding, and an unloading location, and means for always storing at least one supply coil in the respective rotary feeder between the filling location and the unloading location, includes a device proximate to the filling location and actuatable for performing a function leading to prevention of overfilling a respective rotary feeder with the supply coils.

22 Claims, 7 Drawing Figures

AUTOMATIC COIL WINDING MACHINE

The invention relates to an automatic coil winding machine and, more particularly, to such a machine with a multiplicity of winding stations at which supply coil magazines with respective rotary feeders are provided, and with a loading device for loading the magazines with supply coils which are moved by transporting means to the magazines, each of the supply coil magazines having a filling location for automatic loading, and an unloading location, and means for always storing at least one supply coil in the respective rotary feeder between the filling location and the unloading location.

Trouble-free operation of such a winding machine is not assured. It is especially uncertain that the supply-coil magazines of the individual winding stations could be loaded without problems. In particular, malfunctions can be caused by overfilling of the supply-coil magazine. This may be caused, for example, by loading individual supply coils manually. Although a supply-coil magazine was filled by hand, additional supply coils for automatic loading are demanded, so that the supply-coil magazine receives too many supply coils. Furthermore, no prevention is afforded that, after a request for one supply coil, two supply coils would not enter the magazine simultaneously. A malfunction of the supply-coil magazine can also be caused by malfunctioning of a guide mechanism controlling the loading operation, or the like. In all of these cases, the winding operation is disturbed and, in addition thereto, the disturbance is not necessarily immediately recognized.

The invention has as its basic object problem-free loading or supplying of the winding station with supply coils, while avoiding the many aforementioned disadvantages.

With the foregoing and other objects in view, there is provided, in accordance with the invention, a device located at the filling location or at least in vicinity thereof, which prevents and/or reports or signals overfilling of the rotary feeder with the supply coils and, if required or necessary, stops further operation of the malfunctioning rotary feeder.

If, in an exceptional case, the overfilling cannot already be prevented, it should at least be reported or signalled, so that the problem is recognized. If necessary or desirable, the operation of the malfunctioning winding station should also be stopped. However, this should occur only when, for example, the next supply coil is to arrive.

There are different possibilities for preventing overfilling of the rotary feeder. For example, in accordance with another feature of the invention, at the filling location, a transport-means unloading device can be provided which can be activated for supplying supply coils, the unloading device being activated via an operative connection with the supply-coil magazine, and being deactivated via an operative connection with a sensor monitoring the supply coil reception into the rotary feeder. As a result, the transporting-means unloader is activated only if the rotary feeder advances one step, for example. This occurs always when the feeder transfers a supply coil to the winding station. It then has an open place for a new feeding bobbin. After the transporting-means unloader has then taken one supply coil from the transporting means to bring to the filling location, the unloader is again made inoperative, as soon as the sensor recognizes that the rotary feeder has received the supply coil. The transporting-means unloader cannot then supply a second supply coil any more.

In accordance with a further feature of the invention, the transporting-means unloader is constructed as a controllable deflector for a conveyor belt serving as the transporting means. The supply-coil magazine causes the deflector to open when a place for a supply coil is made available in the supply-coil magazine. The sensor causes the deflector to close after the supply coil has been deflected from the conveyor belt and has passed the deflector. The protection against overfilling of the rotary feeder lies thereby in the feature that the opening time of the deflector depends upon the speed or rate at which the coils are supplied, it being impossible, as a rule, for a second supply coil to pass the deflector also.

In accordance with an added feature of the invention, a ramp is located at the filling location between the deflector and the rotary feeder, the ramp being inclined towards the supply-coil magazine, and a coil guide is located at the ramp opposite the deflector. This coil guide is additionally provided with an approximately vertically disposed obstruction which projects into the transporting path of a supply coil which was already removed by the deflector from the conveyor. The coil guide has primarily the function of permitting passage of only a single supply coil. The obstruction serves the purpose of applying an impulse to the supply coil as it slides by, and to cause it to vibrate on its path. The supply coil thereby starts to wobble, and cannot remain hanging between the conveyor belt and the deflector, and also is more likely to find its proper place in the supply-coil magazine due to the wobble.

In accordance with an additional feature of the invention, a spring-loaded flap is provided at the lower end of the ramp and, under the weight of the admitted supply coil, moves down and out of the way, the motion of the flap being monitored by a sensor. The inclined ramp accelerates the supply coil on its way into the supply-coil magazine. One can assume that the supply coil does not remain hanging any more and reaches the supply-coil magazine once it is positioned on the ramp. The flap then moves out of the way as soon as it is touched by the supply coil. The upper part of the supply coil can yet be located near the deflector. Because the sensor monitors the motion of the flap and closes the deflector as the flap moves downwardly and out of the way, the possibility is provided for the deflector additionally to accelerate the supply coil as the deflector closes. In any case, there is no time left or any possibility for another supply coil following the first supply coil to pass the deflector also.

In accordance with yet another feature of the invention, the supply-coil magazine is constructed in the form of a round magazine with a rotary feeder in the form of a rotatable holding spider with receiving pockets, the inserted supply coils extending above the holding spider, with an indexing mechanism for the round magazine which is arranged so that, in each position of the holding spider, one receiving pocket, respectively, is at the filling location and the unloading location, and at least one receiving pocket is disposed between the filling location and the unloading location. Additionally provided, in accordance with the invention, is a controllable supply coil erector arranged in the vicinity of the receiving pocket disposed between the filling location and the unloading location, the coil erector being contactable with a supply coil contained in the receiving pocket as viewed in the transfer direction of the supply coil, when the holding spider is at a standstill. A magazine of this type is suitable both for large and small, as well as for thick and thin supply coils. The coils should not thereby completely disappear in the receiving pockets, in order that one can visually observe them and in order to facilitate the finding and processing of the starting end of the thread. For these reasons, the receiving pockets are not too tightly or sparingly dimensioned, with the result that especially long and thin supply coils lie inclined within the receiving pockets. Thus, it can happen that a previously accepted supply coil extends, due to the inclined position thereof, already up to the filling location, and obstructs thereat the transfer or filling-in of another supply coil. This is especially the case, if the round magazine is not positioned exactly vertically. A slight forward pitch of the round magazine is desirable and practical for reasons of better visual control, and for an easier transfer of the supply coils to the winding station. However, these disadvantages are then especially noticeable. A newly supplied supply coil may be rejected at the filling location due to the inclined position of the preceding supply coil, and may come close to or on top of another supply coil already in the magazine. In this way, the supply-coil magazine becomes overfilled, in spite of the fact that the receiving pocket at the filling location remains empty. The supply-coil erector according to the invention removes this potential source of trouble and ensures that the supply-coil magazine is filled in proper order.

In accordance with yet a further feature of the invention, the supply-coil erector has a back-springing action and construction. In this way, it can better adjust itself to the varying supply-coil forms. In an additional feature of the invention, the supply-coil erector is connected with a sensor which monitors the upright or erect position of the supply coil.

For example, the sensor can generate a signal reporting that the bobbin is not positioned upright. However, it is better yet if the sensor has an operative connection with the transport-means unloader, and/or with the loading device.

In this case, the sensor can be used to control the acceptance of the supply coils. This is accomplished advantageously by arranging for the sensor, every time the coil erector is in the coil erecting position, to send a coil unloading or discharging pulse to the transport-means unloader, and/or a coil loading or deposit pulse to the loading device which loads the transport means. If the coil erector is unable to place the supply coil erector upright, the transporting-means unloader remains inactive, and also provision can be made for the loading device not to transfer any additional supply coils to the transport means.

A further source of problems is the fact that the transport-means unloader and the supply-coil magazine can operate independently of one another. Thereby, overfilling may occur if the supply-coil magazine operates too slowly and, if it operates too rapidly, unoccupied supply-coil positions will occur. To avoid this, it is proposed that the supply-coil magazine be blocked or locked with respect to the transport-means unloader in such a way that the rotary feeder can only be operated if the transport-means unloader is deactivated. Thus, the coil magazine can be operated as before in accordance with the need or demand of the winding station, but only if the transport-means unloader i.e. the deflector, is in the rest position thereof.

It is of advantage if the option is provided to fill the supply-coil magazine manually. For example, if the automatic loading device does not have the capacity to fully satisfy the demand for supply coils, the efficiency of the whole winding machine would necessarily have been reduced, if the possibility of manual feeding or supplying were not provided. On the other hand, it can always happen that a supply coil is not transferred at the transfer location and remains in the rotary feeder. Without special provisions, both of these cases lead necessarily to the overfilling of the supply-coil magazine. To avoid this, in accordance with yet an added feature of the invention, there is provided a supply-coil sensor arranged, as viewed in the transport direction of the rotary feeder, before the receiving pocket disposed at the filling location, the sensor having an operative connection with the transport-means unloader, and/or with the loading device to prevent the transport-means unloader from taking a supply coil from the transporting means, and/or the loading device from depositing or loading a supply coil onto the transport means, if a receiving pocket, which has already been filled some other way, arrives at the filling location as the supply-coil magazine is advanced. For example, the supply-coil sensor can be provided with a sensing lever which projects into the supply-coil transport path of the rotary feeder and which is swingable away when it touches the supply coil. The sensing lever can be arranged so that its path as it swings away touches or crosses the downwardly movable flap which is disposed at the filling location. In this case, the flap is operated by the sensing lever, the deflector being closed. Independently of whether or not the loading device has deposited a supply coil onto the transporting means, no supply coil can automatically reach the filling location any more if the deflector is closed. A possible malfunction can also be caused if the transport-means unloader stops in an in-between position, for example, if it is blocked by a supply coil which has become stuck there. In this condition, no supply coils can reach the supply-coil magazine in the normal way, however, by the continued discharge or unloading of supply coils, a pile-up is produced initially at the transport-means unloader, and finally the supply coils drop in an unorderly fashion into the supply-coil magazine, which is equivalent to overfilling in exchange with unoccupied coil positions. To avoid this, in accordance with a further feature of the invention, the transport-means unloader is provided with a monitor which is triggered if the transport-means unloader stops in an in-between position, the monitor having an operative connection with the loading device, to prevent the loading device from depositing or loading supply coils on a blocked transport-means unloader. Furthermore, the monitor can be provided with an operative connection with a malfunction-indicating device.

It may happen that, in an automatic coil winding machine, in spite of all the aforedescribed measures, a given winding station may have a tendency to present problems, especially due to overfilling of the supply-coil magazine. During the operation of the machine, such malfunctions are difficult or impossible to repair. Furthermore, it is of advantage to remove individual winding stations from the automatic coil supply arrangement and to load them with supply coils exclusively by hand. To avoid overfilling when operating in this mode, it is proposed, in accordance with a concomittant feature of the invention, that a manually operated cut-off device be provided in the operative connection which extends from the supply-coil magazine to the transport-means unloader, and/or to the loading device. The respective winding station can in that way be excluded from the automatic coil supplying system by using this cut-off device. This cut-off device can also be a plug connection which is manually disconnectible.

Other features which are considered as characteristic for the invention are set forth in the appended claims.

Although the invention is illustrated and described herein as embodied in an automatic coil winding machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
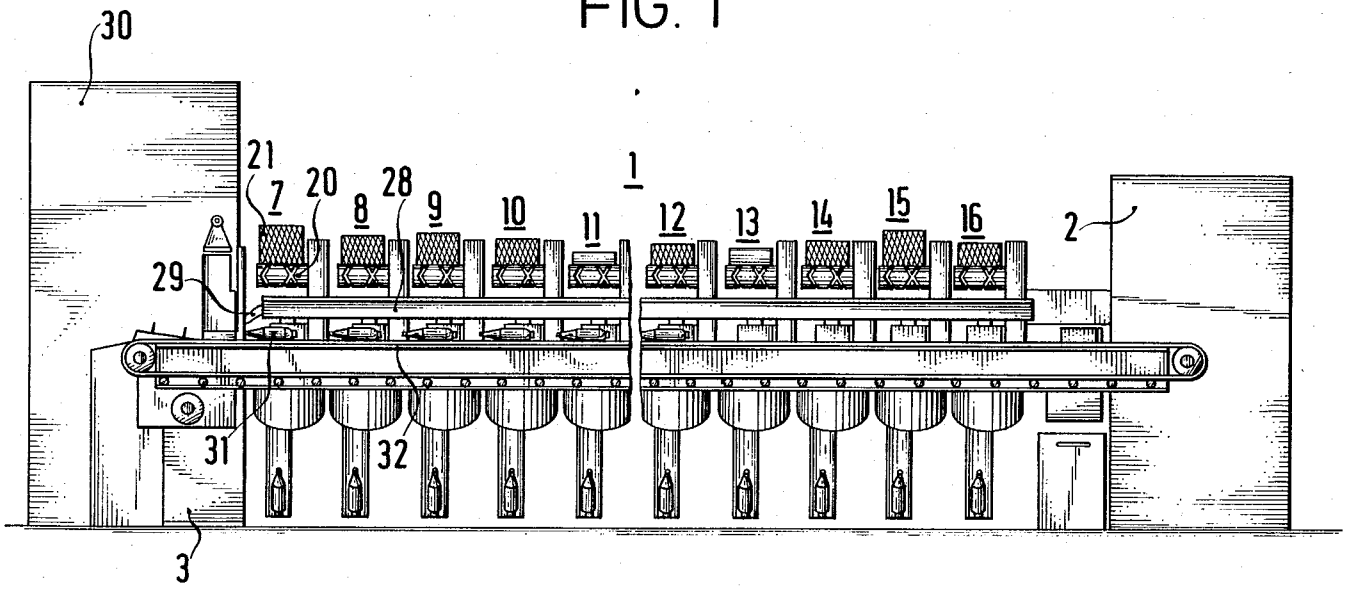
FIG. 1 is a diagrammatic front elevational view of an automatic winding machine with ten winding stations.

Referring now to the drawing and, first, particularly to FIG. 1 thereof, there is shown an automatic winding machine identified as a whole by reference numeral 1. It includes a rear end frame 2, and a frontal end frame 3. As shown especially in FIG. 3, the two end frames are connected to one another by a profiled crossbar or traverse 4 and two tubular crossbars or traverses 5 and 6. The individual winding stations 7 to 16 are fastened to the tubular crossbars 5 and 6.

The details of a winding station are explained hereinafter with regard to the winding station 7 especially illustrated in FIG. 3.

The main parts of the winding station 7 are an unwinding location 17 for the supply coils, a thread tensioning device 19, a drive roller 20 provided with reverse-winding grooves for a take-up coil 21 in the form of a cross-wound bobbin or cheese having a pivotal holder 22. The reverse-winding grooves of the drive roller 20 serve for guiding the yarn 23. A collection trough 24 for ejected empty coil tubes or cores 25 is provided at floor level. The winding station 7 also is provided with a supply coil magazine 26, which is constructed as a round magazine and is attached to a chute 27 which leads to the unwinding location 17. A yarn suction device 28 is arranged above the supply coil magazine 26. The thread suction device 28 is attached to a source of suction air by a flexible suction tube 29. In the supply coil magazine 26, additional feeding bobbins 18' are stored.

Adjacent and above the frontal end frame 3, a loading device 30 is positioned, which serves for loading the supply coil magazines 26 with supply coils 18, 18'.

The loading device 30 has the capability of depositing, on command, individual supply coils 31 in sequence upon a transporting or conveying device 32. In the case at hand, an endless conveyor belt serves as the transporting device 32, the upper course or run of the belt being guided by a wall 33 which serves to prevent the supply coils 31 from falling off the belt during transport.

Figure 2:
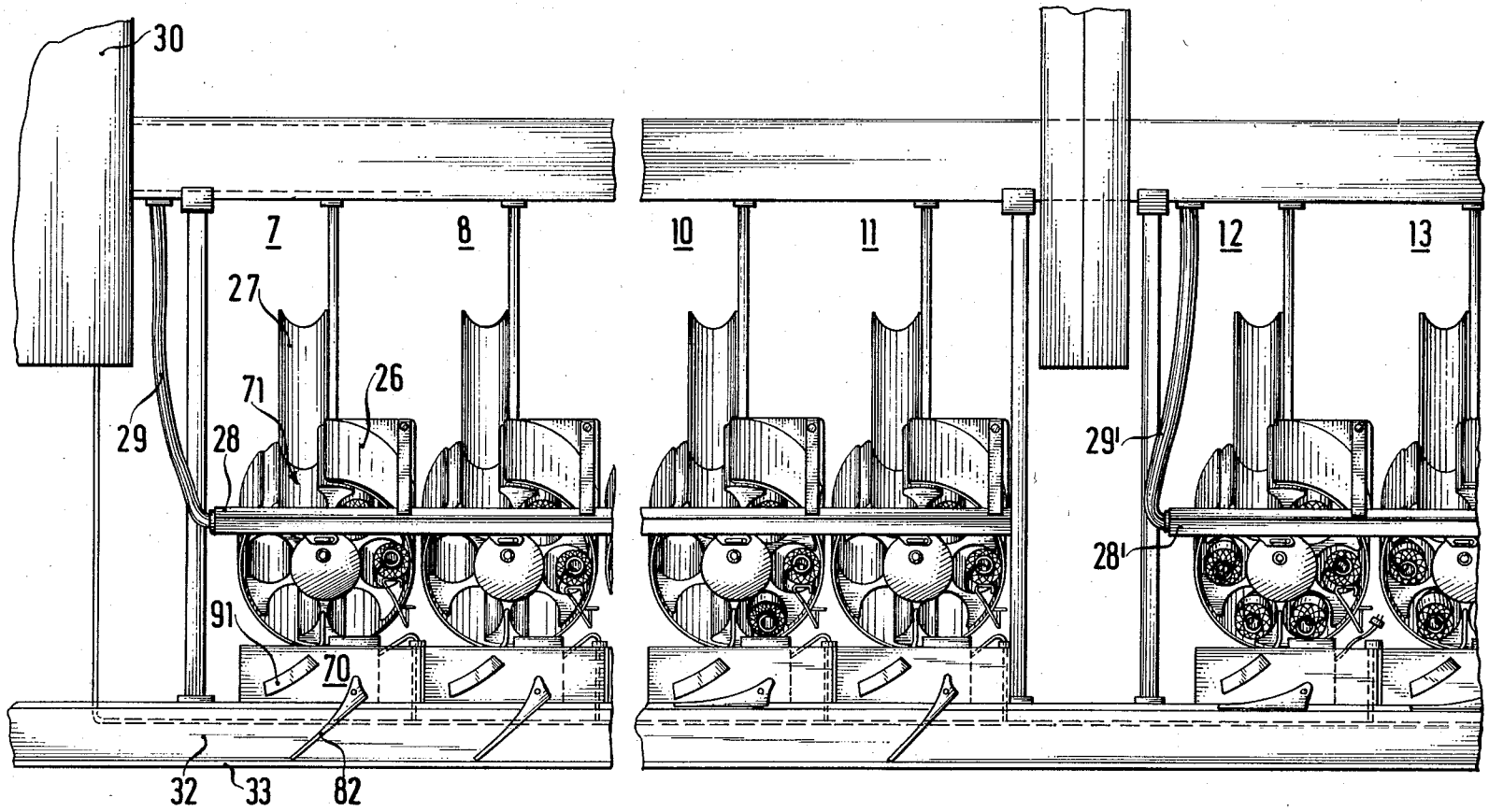
FIG. 2 is an enlarged fragmentary top plan view of FIG. 1, showing several of the supply coil magazines of several winding stations.

Whereas only one thread suction device 28 with one suction tube 29 is shown in FIG. 1, it is believed to be clear from FIG. 2 that these parts can also be arranged in sections. Thus, FIG. 2 shows also a second thread suction device 28' with a second suction tube 20'.

Figure 3:
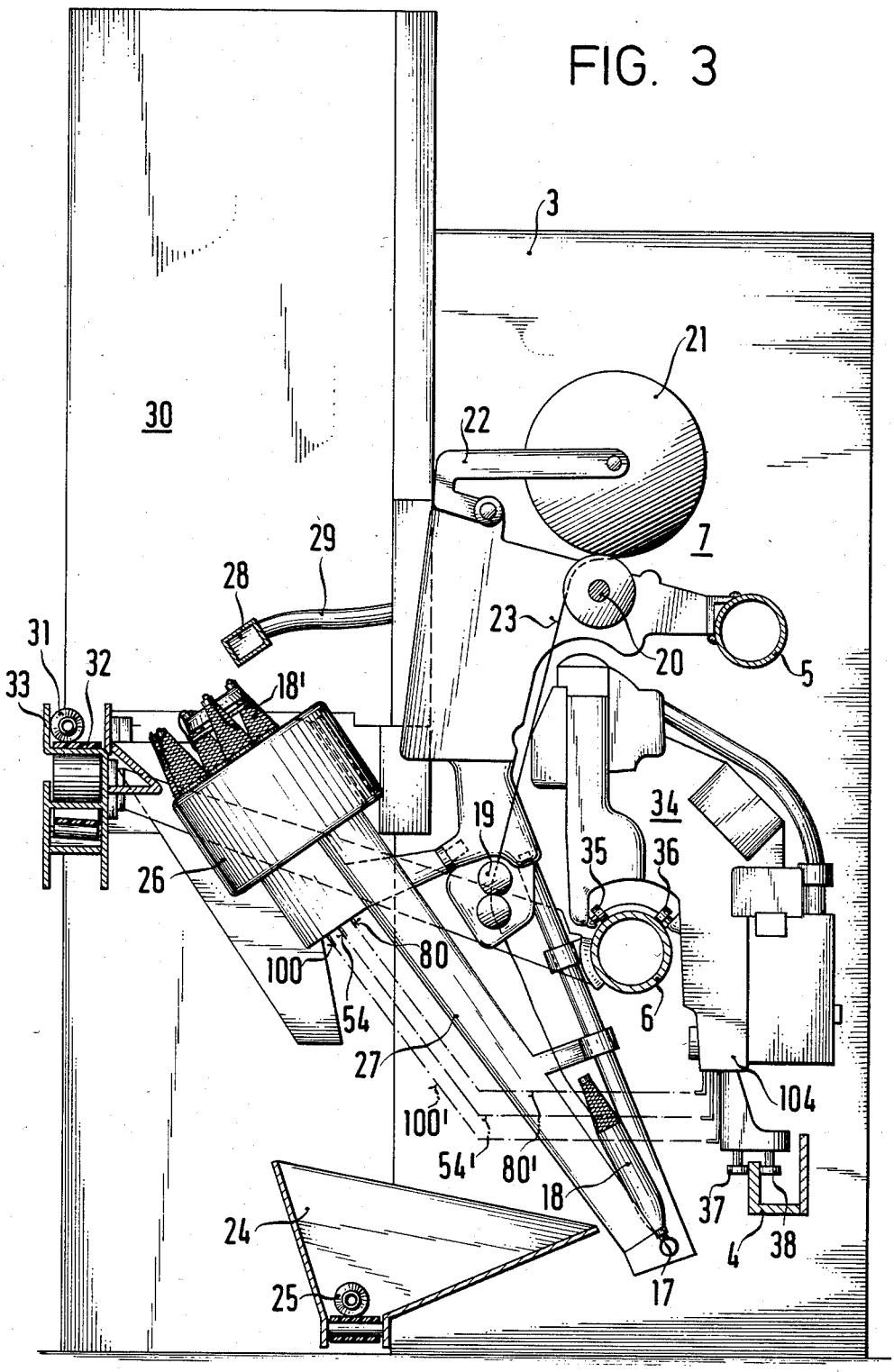
FIG. 3 is a diagrammatic side elevational view of one of the winding stations of FIG. 2.

FIG. 3 illustrates a thread-break repairing device which is identified as a whole by reference numeral 34. It is arranged so as to be able to travel along the length of the coil winding machine 1 and, for this purpose, rests on the tubular crossbar or traverse 6 with drive rollers 35, 36, and is supported by support rollers 37, 38 on the profiled crossbar 4. The tubular crossbar 6 serves as a rail or track for the thread-break repairing device 34, and the profiled crossbar 4 serves as a support for the device 34.

Details of the supply coil magazine 26 are shown in FIGS. 2 and 4 to 7. For example, the supply coil magazine 26 is constructed as a round magazine having a stationary central tube constructed as a suction tube 39, a central container 40 having a bottom wall 41 and an open top, the bottom wall 41 having an opening 42 (FIG. 5) which permits the discharge of a supply coil 18' (FIG. 4) in a direction towards the unwinding location 17 (FIG. 3). The opening 42 in the bottom 41 has approximately the form of a circular sector. The central tube 39 carries two support sleeves 43, 44 which support a rotary feeder in the form of a holding spider 45 rotatable in transport direction. The transport direction is identified by an arrow 46 in FIG. 5. The holding spider 45 forms six pockets 47, which serve for receiving the supply coils 18'. According to FIG. 5, the rotary feeder and holding spider 45 are loaded with the supply coils 18', 18'' and 18'''.

Figure 5:
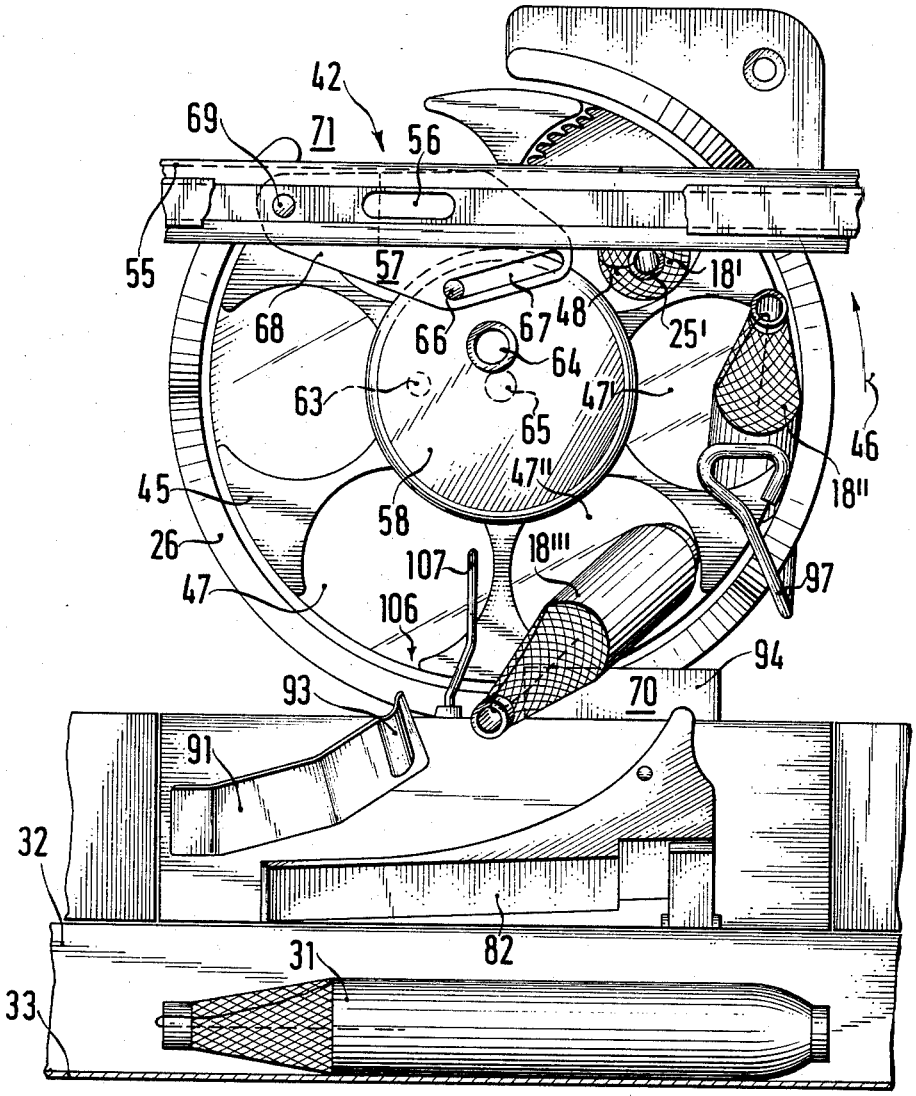
FIGS. 5, 6 and 7 are all top plan views of FIG. 4, rotated through 90°, showing, in three different phases, the transfer of a supply coil therefrom and the reception of a new coil therein.

FIG. 5 shows that the supply coils are spinning cops 18', 18'', 18''' which are wound onto coil cores or tubes 25'. The lower end of the coil tubes 25' always lies on the bottom 41 of the magazine 26. One can see, at the upper end of the coil tube 25', that the starting end 48 of the yarn or thread is inserted into the interior of the tube 25'. All of the supply coils have been made-ready in this way in the loading device 30, so that the starting ends of the thread or yarn thereof is ready to be gripped at a predetermined location. The insertion of the made-ready supply coils into the magazine 26 is effected selectively automatically, or manually.

Figure 4:
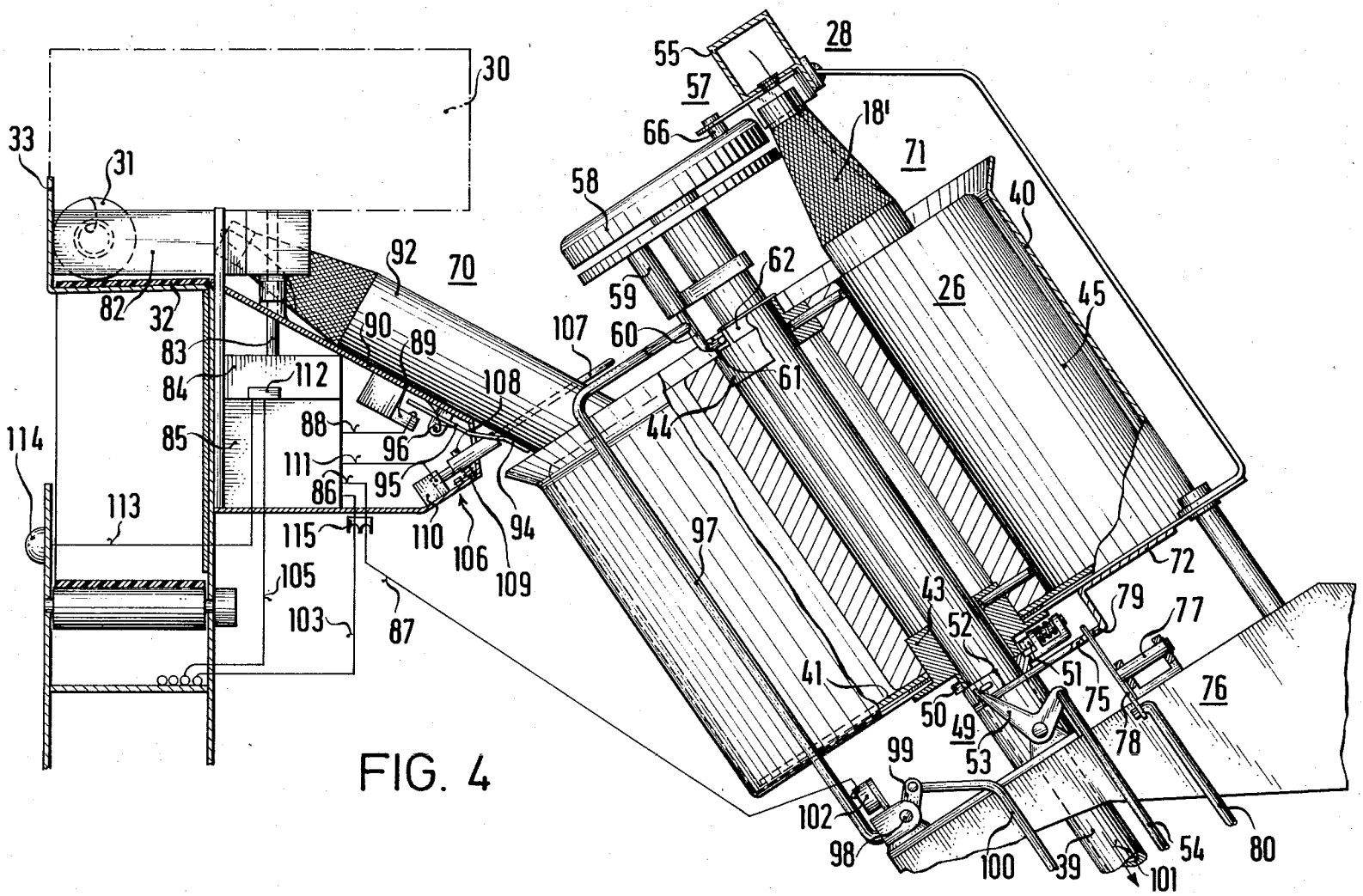
FIG. 4 is an enlarged fragmentary, partly sectional view of FIG. 3 showing the supply coil magazine of the winding station and transporting means for the supply coil.

According to FIG. 4, the supply coil magazine or round magazine 26 is provided with a turret indexing mechanism 49. This mechanism 49 has the purpose of advancing the holding spider 45 an indexing step at a time. In this regard, the support sleeve 43 is provided with a ratchet wheel 50 wherein a latch 51 engages, preventing rotation in the opposite direction. Furthermore, a locking pawl 52 also engages in the ratchet wheel 50 and is operatable by a bellcrank lever 53. The bellcrank lever 53 articulates with a shifter-rod 54.

The thread suction device 28 includes a suction tube 55 which extends from winding station to winding station. The suction tube 55 is provided with suction openings at the underside thereof. FIG. 5, for example, shows a suction opening 56. A shifting mechanism is provided at the respective thread suction device 28 at each winding station. In FIG. 5, the shifting mechanism of the winding station 7 is identified by a reference numeral 57. The shifting mechanism 57 includes a cover 58 which lies centrally on the upper end of the suction tube 39 and thereby closes the suction tube. The cover 58 is eccentrically supported in a support sleeve 59 which is connected to the suction tube 39. A shaft 60 which is connected to the cover 58 serves this purpose, the shaft 60 terminating in a sensing lever 61. The sensing lever 61 follows a cam disc 62 which is connected to the support sleeve 44. By this arrangement, the cover 58 can swing around a pivot point 63 (FIG. 5). The cover 58 has an eccentrically disposed opening 64 which, as the holding spider 45 is advanced in the direction of the arrow 46, is positioned in passing above the upper opening 65 of the suction tube 39 due to the swinging motion of the cover 58 about the pivot point 63.

The cover 58 furthermore has an eccentrically disposed pin 66 which, according to FIG. 5, engages in a slot 67 of a slider 68. The slider 68 is fastened to a swivel joint 69 which is connected to the suction tube 55. The slider 68 contacts the suction tube 55 at the bottom thereof, and thereby closes the suction opening 56, as shown in FIG. 5. The instant the cover 58 is in the suction position, however, the slider 68 opens a part of the suction opening 56, as shown in FIG. 6.

Figure 6:
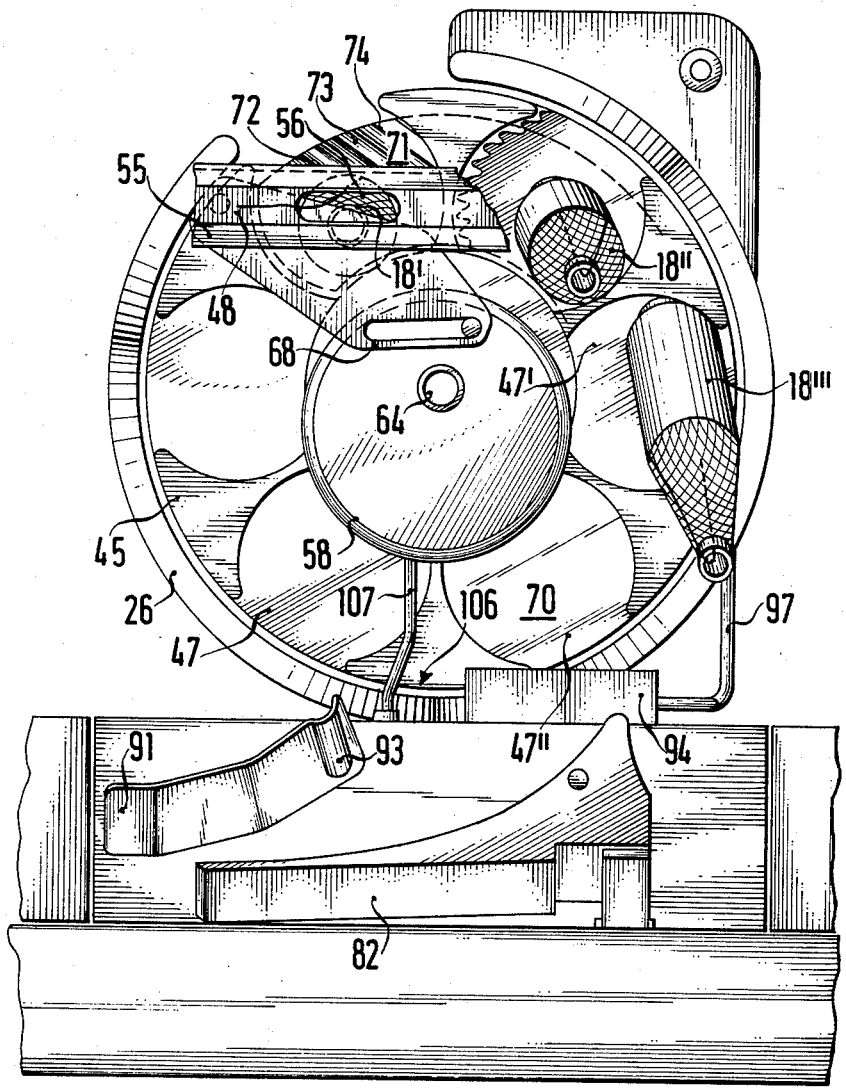

FIGS. 2 and 5 to 7 show that the supply coil magazines 26 each have a predetermined filling location for automatic loading, and a predetermined discharge location. The supply coil magazine 26 of the winding station 7, for example, has the filling location 70 and the discharge location 71. FIG. 5 shows that the two supply coils 18′ and 18″ are held stored between the filling location 70 and the discharge location 71. The supply coil 18‴ has just arrived at the filling location 70, and there is no supply coil at the discharge location 71. By advancing the rotary feeder and the holding spider 45, respectively, one indexing step in direction of the arrow 46, an empty pocket 47 reaches the filling location 70, and the pocket containing the supply coil 18′ reaches the discharge location 71, as shown in FIG. 6. Two supply coils thus remain stored between the filling location and the discharge location.

FIGS. 4 and 6 show that a support device 72, which is pivotable away, is provided below the supply coil 18′ at the discharge location 71 i.e. where a supply coil 18′ is to be surrendered in the direction towards the unwinding location 17 (FIG. 3).

The support device 72 is formed of a plate 73 which is provided with uneven surface portions 74 which permit air to flow into the foot of the coil cores or tubes. These unevenesses 74 are waves or corrugations which are pressed into the plate 73. According to FIG. 4, the support device 72 is provided with a holding arm 75 which is swingably mounted on the central suction tube 39. An actuating device identified as a whole by the reference numeral 76 is connected to the holding arm 75. The actuation device 76 has a pivot shaft 77 to which a two-armed lever 78 is fastened. One end of the lever 78 projects through an opening 79 which is formed in the holding arm 75. The other end of the two-armed lever 78 articulates with a shifter rod 80.

At the filling location 70 and in the vicinity thereof, devices are arranged for the purpose of preventing and/or reporting the over-filling of the rotary feeder 45 and, if necessary, to stop the further operation of a malfunctioning rotary feeder. These devices are further explained hereinafter.

At the filling location 70, a transport-means unloader 82 is arranged which is shiftable into a coil unloading position thereof. The transport-means unloader 82 is made up of a controllable deflector for the conveyor belt 32 serving as the transporting means. The deflector 82 is formed of a swing-lever 83 which ends at an electromagnetic shifting mechanism 84. The electromagnetic shifting mechanism 84 is part of an electric switching unit 85. All connections associated with circuit and switching functions are made in the electric switching unit 85 and will be discussed hereinafter.

The deflector 82 is actuated by an operative connection 86, 87 with the supply coil magazine 26. For deactuation thereof, the deflector 82 is provided with an additional operative connection 88 with a sensor 89 which monitors the acceptance of coils into the rotary feeder 45.

Figure 7:
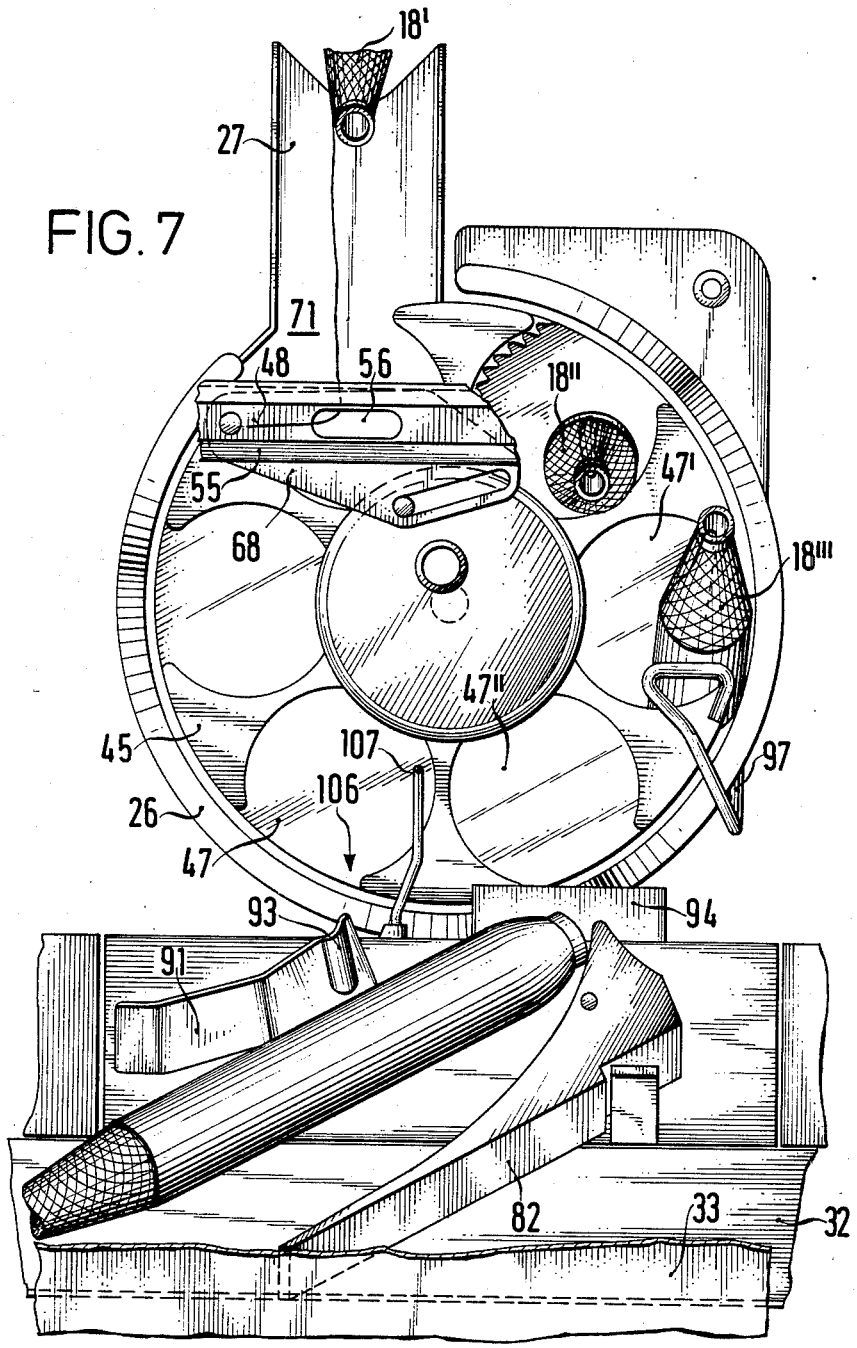

As shown especially clearly in FIG. 4, a ramp 90 inclined towards the supply coil magazine 26 is disposed at the filling location, between the deflector 82 and the rotary feeder 45. Coil guide means 91 are provided at the ramp 90 opposite the deflector 82. FIGS. 5 to 7 show that this coil guide means 91 is formed of a somewhat vertically disposed, slightly curved sheet-metal element which has a likewise, somewhat vertically oriented obstacle 93 projecting into the transport-path of a supply coil 92 (FIG. 7) which was deflected from the conveyor belt 32 by the deflector 82. The obstacle 93 is formed by a ridge or bead which was impressed into the coil guide member 91.

At the lower end of the ramp 90, a flap 94 is provided. This flap 94 is loaded by a spring 95. The spring 95 is constructed in the form of a wound flexing or spiral spring. The flap 94 is swingable about a swivel joint 96. The sensor 89 is formed of a switch which is connected to the back end of the flap 94. As long as the flap 94 is in upwardly swung position due to the action of the spring 95, the back end of the flap 94 engages the switch 89. However, when a supply coil 92 rests on the flap 94, as shown in FIG. 4, the back end of the flap then lifts away from the switch 89, so that the switch 89 switches over. Due to the switching-over of the switch 89, a closing pulse goes through the operative connection 88 to the shifting mechanism 84 of the deflector 82.

FIGS. 5 to 7 show that a controllable coil erector 97 is arranged near the receiving pocket 47′ directly behind the filling port 70 in rotation direction 46 of the holding spider 45. The coil erector 97 is then always engageable with a supply coil in the receiving pocket 47′, for example the supply coil 18″ (FIG. 5), if the holding spider 45 stands still. The coil erector 97 engages the coil 18″ in the transport direction thereof. The coil erector 97 has a back-springing action. It is formed of a hook-shaped element made of elastic material. The back-springing action can also be effected by a wound spiral spring of somewhat varied construction which may be arranged at the pivot or swivel joint 98 of the coil erector 97. A lever 99 which is articulatingly connected to a shifter rod 100 has a mechanical connection with the coil erector 97. The coil erector 97 contacts the supply coil 18″ the instant the shifter rod 100 is drawn in direction of the arrow 101, as shown in FIG. 4.

The coil erector 97 is connected to a sensor 102 which monitors the upright position of the coils. The sensor 102 is constructed as a switch, and has the hereinaforementioned operative connection 87, 86 with the transport-means unloader 82. At the same time, there is an additional operative connection with the loading device 30 via the switching unit 85 and a conducting line 103. Whenever the coil erector 97 comes into the coil-erecting position, as shown in FIG. 4, the sensor 102 transmits a coil transfer pulse to the transport-means unloader 82 and, simultaneously, a coil discharge pulse to the loading device 30 which loads the transport means 32.

FIG. 3 indicates that operative connections 54', 80' and 100' lead from the shifter rods 54, 80 and 100 to a control unit 104 of the thread or yarn-break correction device 34. The shifter rods are actuated by the thread-breakage correction device 34. Actuation of the control rod 54 depends indeed upon the position of the deflector 82. An operative connection exists from the electromagnetic switching device 84 of the deflector 82 via a line 105 to the control unit 104 of the thread or yarn-break repairing or correction device 34. This operative connection has the purpose of locking the coil magazine 26 with respect to the transport-means unloader 82. The locking is effected in a manner that the rotary feeder 45 can only operate if the transport-means unloader 82, respectively, are de-activated i.e. are in the rest position thereof. Otherwise, the shifter rod 54 cannot be operated.

According to FIGS. 4 to 7, a supply coil sensor 106 is arranged, as viewed in the transport direction of the rotary feeder 45, before the receiving pocket 47'' located at the filling location 70. The supply coil sensor 106 has a sensing lever 107, which projects into the coil transporting path of the rotary feeder 45, and which is swingable away when it touches a supply coil. According to FIG. 4, the sensing lever 107 is swingable about a pivot 108, and is spring-loaded by a wound spiral spring 109. The back end of the sensing lever 107 acts upon a switch 110, from which an operative connection 111 leads via the switching unit 85 to the transport-means unloader 82, and via the line 103, simultaneously, also to the loading device 30. The operative connection 111 is activated the instant the sensing lever 107 is pivoted outwardly even just slightly. In this case, the transport-means unloader 82 and the loading device 30 become de-activated. This thereby prevents a supply coil from being able to be taken from the transport means 32 by the transport-means unloader 82. At the same time, the loading device 30 is prevented from supplying a supply coil to the transport means 32, if a previously otherwise-filled receiving pocket, in this case the receiving pocket 47, reaches the filling location 70 when the supply coil magazine 26 is advanced. This represents an effective protection against overfilling of the rotary feeder 45. This protection is doubly effective, because the sensing lever 107 is simultaneously arranged in such a manner that the pivot path thereof touches and crosses the downwardly deflecting flap 94 located at the filling location 70. The instant the flap 94 deflects downwardly, the sensor 89 also causes the deflector 82 to close, so that also for this reason no supply coil can get onto ramp 90. The closing pulse of the deflector 82 always has preference over an opening pulse.

The transport-means unloader 82 is provided with a monitor or detector 112 which responds to the stopping of the transport-means unloader 82 in an intermediate position, this monitor 112 being part of the electromagnetic shifting mechanism 84. The monitor 112 has an operative connection with the loading device 30 via the line 105 for preventing the loading device 30 from delivering supply coils to a blocked transport-means unloader 82. Moreover, the monitor 112 has an operative connection 113 with a malfunction indicator or signaling device 114.

The demand for more supply coils is effected by the sensor 102 of the supply coil magazine 26. If the operative connection 86 leading to the transport-means unloader 82 and the operative connection 103 leading to the loading device 30 remain inactive, no supply coils can be supplied any more automatically into the supply coil magazine 26. Also, there is no demand for additional supply coils. To effect this, the operative connections 87 and 103 are separable from the electrical switching unit 85 by a manually actuable interrupter or disconnector 115 in the form of a plug member.

FIG. 3 shows the winding station 7 during normal operation. The thread 23 is unwound from the supply coil 18 and wound onto the take-up coil 21. When the supply coil or cop 18 which has only a limited supply of yarn or thread becomes empty, the winding station 7 automatically senses the absence of the thread 23, and transmits the signal "thread is missing" to the thread-break repairing or correction device 34.

The thread-break repairing or correction device 34 which shuttles back and forth reciprocatingly on the tubular crossbar 6, stops in front of the winding station 7 upon receiving this signal and initiates all preparatory work for correcting the thread interruption. This entails that, first, a check is made as to whether a supply coil with sufficient thread supply is located at the feeding location 17. Since this is not the case, the empty coil core or tube is initially removed by the thread break correction device 34 and ejected into the collection trough 24. The details of this operation are not further explained herein since they are well known and are, furthermore, otherwise not essential to the invention.

At this instant of time, the round magazine 26 is in the position thereof indicated in FIG. 5. The suction opening 56 of the suction tube 55 is closed by the slider 68. In order to suck-in the starting end of the thread 48, the next following supply coil 18' must be moved under the suction opening 56. To make this possible, the control unit 104 of the thread-break correction device 34 activates the shifter rod 80 via the operative connection 80'. By pulling the shifter rod 80, the plate 73 of the support device 72 swings under the unloading location 71, as shown in FIG. 6. Thereafter, the control unit 104 acts upon the shifter rod 54 via the operative connection 54', with the result that the turret indexing device 49 is actuated, the rotary feeder and the holding spider 45, respectively, being advanced one index step. To make this possible, the coil erector 97 must swing back, as shown in FIG. 6. This is effected by the arrangement that the control unit 104 simultaneously acts upon the control rod 100 via the operative connection 100', lifts the control rod 100 and thereby swings the coil erector 97 in a counterclockwise direction.

After the holding spider 45 has again come to a stop, the control unit 104 causes the shifter or control rod 100 to draw back in direction of the arrow 101. This causes the coil erector 97 to lie against the supply coil 18''' which is then disposed in the receiver pocket 47' in accordance with FIG. 7, and thereby the erector 97 directs the supply coil into an upright position. As long as the coil erector 97, during the erecting operation thereof, is in contact with the sensor 102, an "open"-command is transmitted to the deflector 82 via the operative connection 87, 86. The deflector 82 swings over the conveyor belt 32, as shown in FIG. 7. Simultaneously, the sensor 102 also initiates the deposit at the loading device 30 of a supply coil onto the conveyor belt 32 via the conductor line 103. This supply coil or a supply coil which was already previously deposited on the conveyor belt 32 is then guided by the deflector 82 via the ramp 90 into the receiving pocket standing empty at the filling location 70. In accordance with FIG. 7, the supply coil 92 is just being guided at this instant into the receiving pocket 47".

When the turret indexing mechanism 49 is operated, the cover 58 swings around the pivot point 63 with the aid of the cam disc 62, the sensing lever 61 and the shaft 60, with the result that the opening 64 formed in the cover 58 receives a supply of suction air therein. This arrangement permits an operator to manually place a supply coil into an empty pocket in the supply spool magazine and to place the thread end before the opening 64 to be drawn into the opening and clamped between the cover 58 and suction tube 39 as is conventional in the art. At the same time, the pin 66 opens the suction opening 56 of the suction tube 55 due to the motion of the slider 68 (FIG. 6). The starting end of the thread 48 of the supply coil 18' which then stands ready on the plate 73, can be sucked into the suction tube 55, as is also shown in FIG. 6. The suction opening 56 is only opened briefly during the advance of the holding spider 45. This opening time is sufficient, however, to suck-in the starting end of the thread. After the holding spider 45 has rotatably advanced an indexing step, as shown in FIG. 7, the suction openings are again located in the closed position thereof. The starting end of the thread remains clamped between the slider 68 and the edge of the suction opening 56.

The transfer of the supply coil 18' via the chute 27 to the feeding location 17 is effected at the time when the holding spider 45 is at rest again after the rotation thereof. In this regard, the plate 73 of the support device 72 is again retracted by the shifter rod 80, as shown in FIG. 7. These functions also are performed by the control unit 104 of the thread break correction device 34 via the operative connection 80' which acts upon the shifter rod 80.

The instant the supply coil 92 which was deflected from the transport-means 32 lies with the lower end or foot thereof on the plate 94, as shown in FIGS. 4 and 7, the deflector 82 receives a "close"-command from the sensor 89. The deflector 82 closes immediately after or behind the supply coil 92, so that no other supply coil can then be deflected from the conveyor belt 32.

If the supply coil 92 should be stuck or clamped between the deflector 82 and the coil guide 91, the monitor 112 becomes functional, turns on the malfunction indicator 114 and blocks the loading device 30. The winding station 7 can initially continue to operate undisturbed, until the supply of coils in the supply coil magazine 26 is exhausted. However, before this should happen, the malfunction, as a rule, is usually corrected by the operating personnel. If the coil erector 97 should fail to erect a supply coil properly, so that the sensor 102 is triggered, neither the deflector 82 is opened nor any supply coil deposited from the loading device 30. The winding station 7 initially continues to operate undisturbed also thereby. Also no signal is generated because, at the next indexing step of the supply coil magazine 26, the coil erector 97 must be functioning again, because there is then no supply coil in the receiving pocket swept over by the erector 97. An empty space remains in one pocket of the coil magazine, and at the request for supply coils generated by the thread-break correction device 34, a repeat operation is performed, which represents only a small time loss with respect to the normal operating cycle.

As noted hereinbefore, the invention is not limited to the illustrated and described embodiment used by way of a best example. In some cases, for example, it may be of advantage to prevent the advance of the rotary feeder for as long as there is still an empty pocket at the filling location. It could be possible namely that a supply coil may be unwound or emptied faster than the time required to refill the magazine. In such a case, the thread-break connection device would advance the rotary feeder too soon. To prevent this, the sensor 89 could be provided with an additional operative connection, for example, which serves to unblock the thread-break correction device. Instead of a cut-off switch for individual winding stations, a cut-off switch for whole groups of winding stations could be provided. Thereby, the possibility would be provided of removing with one switch movement several winding stations simultaneously from the system for automatically supplying the supply coils.

We claim:

1. Automatic coil winding machine having a multiplicity of winding stations for which supply coil magazines with respective rotary feeders are provided, and having a loading device for loading the magazine with supply coils which are moved by transporting means, which include a conveyor belt, to the magazines, each of the supply coil magazines having a filling location for automatically loading the magazine, and an unloading location, and means for continuously storing at least one supply coil in the respective rotary feeder between the filling location and the unloading location, including a device proximal to the filling location for prevention of overfilling the filling location, the device which comprises:

a switchable transport means unloader for unloading excess coils;

a sensor for monitoring the loading condition at the filling location;

linkage from the sensor to the switchable transport means unloader operatively engaging the unloader for unloading an excess coil when an overload condition is detected at the filling location.

2. Automatic coil winding machine according to claim 1 wherein said device comprises means responsive to said sensor for signalling the machine operator of a potential overfilling condition of the respective rotary feeder.

3. Automatic coil winding machine according to claim 1 wherein said device includes means responsive to said sensor for automatically stopping further operation of an overfilled and malfunctioning rotary feeder.

4. Automatic coil winding machine according to claim 1 including a transporting-means unloading device located at the filling location for supplying supply coils to the respective rotary feeder, said unloading device having means operatively connected to the respective supply coil magazine for activating the respective rotary feeder, and means operatively connected to a sensor monitoring supply coil reception in the respective rotary feeder for deactivating the respective rotary feeder.

5. Automatic coil winding machine according to claim 4, wherein said transporting-means are a conveyor belt, and said transporting-means unloading device is constructed as a switchable transport means unloader for said conveyor belt.

6. Automatic coil winding machine according to claim 5, including a ramp located at the filling location between said switchable transport means unloader and the rotary feeder, said ramp being inclined towards the supply coil magazine, and including a coil guide located at said ramp and opposite said transport means unloader.

7. Automatic coil winding machine according to claim 6, including a flap located at a lower end of said ramp, said flap being spring biased and being downwardly movable and out of the way under a supply coil received on said ramp, the movement of said flap being monitored by said sensor.

8. Automatic coil winding machine according to claim 1, wherein the supply coil magazine comprises a round magazine, and the rotary feeder which includes a rotatable holding spider formed with receiving pockets in which the supply coils are receivable with ends thereof extending above said holding spider having receiving pockets, and including an indexing mechanism for said round magazine actuatable so that, in each position of said holding spider, one receiving pocket is at the filling location, one receiving pocket is at the unloading location, and at least one receiving pocket is disposed between the filling location and the unloading location, and a controllable coil erector disposed proximal to said receiving pocket located between the filling location and the unloading location, said coil erector being continuously contactable with a supply coil received in said receiving pocket in transport direction of the supply coil when the holding spider is at a standstill.

9. Automatic coil winding machine according to claim 8, wherein said coil erector has a swing-back construction, which comprises a control unit, a control rod, an operative connection responsive to the control unit for engaging the control rod to swing back the coil erector.

10. Automatic coil winding machine according to claim 7, wherein said coil erector is connected to a sensor monitoring the erect position of the supply coil.

11. Automatic coil winding machine according to claim 10, wherein said sensor has an operative connection with said transport-means unloading device.

12. Automatic coil winding machine according to claim 10, wherein said sensor has an operative connection with a loading device for loading the transport-means with the supply coils.

13. Automatic coil winding machine according to claim 12, wherein said sensor also has an operative connection with said transport-means unloading device.

14. Automatic coil winding machine according to claim 13, including means for transmitting from said sensor monitoring the erect position of the supply coil a supply-coil unloading pulse to said transport-means unloading device whenever said erector is in coil erecting position, and a supply-coil loading pulse to said loading device loading the transport-means.

15. Automatic coil winding machine according to claim 3, including means for blocking the supply coil magazine with respect to said transport-means unloading device in a manner that the rotary feeder is operatable only if the transport-means unloading device is deactivated.

16. Automatic coil winding machine according to claim 13 including a supply-coil sensor, being disposed before the receiving pocket located at the filling location, as viewed in transport direction of the rotary feeder, said supply-coil sensor having an operative connection with said transport-means unloading device and said transport-means loading device so as to prevent said transport-means unloading device from taking a supply coil from the transport means, and said transport-means loading device from loading a supply coil onto the transport-means when a receiving pocket filled by other means has arrived at the filling location upon advancement of the supply-coil magazine.

17. Automatic coil winding machine according to claim 16, wherein said supply-coil sensor further comprising a sensing lever projecting into the supply-coil transporting path of the rotary feeder, and swingable away when contacting a supply coil in the transporting path.

18. Automatic coil winding machine according to claim 17, wherein said sensing lever has a path of swing at least meeting said downwardly movable flap located at the filling location.

19. Automatic winding machine according to claim 13, wherein said transport-means unloading device further comprises a monitor triggerable in response to said transport-means unloading device being stopped in an in-between position, said monitor having an operative connection with said transport-means loading device for preventing said loading device from supplying supply coils via the transport means to a transport-means unloading device which has been blocked.

20. Automatic coil winding machine according to claim 11 including a manually operable cut-off device in said operative connection extending from the supply-coil magazine to said transport-means unloading device.

21. Automatic coil winding machine according to claim 12, including a manually operable device in said operative connection extending from the supply-coil magazine to said transport-means loading device.

22. Automatic coil winding machine according to claim 13, including a manually operable device in said operative connections extending from the supply-coil magazine to said transport-means unloading device and said transport-means loading device.

* * * * *